US005844214A

United States Patent [19]

Hoh

[11] Patent Number: 5,844,214

[45] Date of Patent: Dec. 1, 1998

[54] POWER SUPPLY CUT-OFF APPARATUS IN A MICROWAVE OVEN

[75] Inventor: Jung-Eui Hoh, Suwon, Rep. of Korea

[73] Assignee: Samsung Electronics Co., Ltd., Suwon, Rep. of Korea

[21] Appl. No.: 871,907

[22] Filed: Jun. 12, 1997

[30] Foreign Application Priority Data

Jun. 27, 1996 [KR] Rep. of Korea ..... 96-18061 U
Jun. 27, 1996 [KR] Rep. of Korea ..... 96-24755

[51] Int. Cl.[6] ..... H05B 6/68

[52] U.S. Cl. ..... 219/723; 219/702; 219/716; 219/756; 219/509; 126/197

[58] Field of Search ..... 219/723, 722, 219/724, 756, 702, 715, 509, 716; 200/50.02, 50.14, 50.08, 50.1, 61.62, 61.76, 61.81; 126/197

[56] References Cited

U.S. PATENT DOCUMENTS 4,277,659 7/1981 DeRemer ..... 200/61.62
4,394,565 7/1983 Dills ..... 219/509
4,712,154 12/1987 Madsen ..... 219/509

FOREIGN PATENT DOCUMENTS 52-37241 3/1977 Japan ..... 219/723
55-56534 4/1980 Japan ..... 219/722

*Primary Examiner*—Philip H. Leung
*Attorney, Agent, or Firm*—Burns, Doane, Swecker & Mathis, L.L.P.

[57] ABSTRACT

A microwave oven includes an electric power supply shut-off mechanism for cutting off the supply of electric power when the housing is disassembled for repair while an electric power cord remains plugged into an electric outlet. A sensor in the form of a light sensitive semiconductor and/or a piezoelectric crystal senses when panels of the oven housing are removed and thereupon causes a controller to actuate a solenoid which deactivates a safety switch for cutting off the supply of electric current.

5 Claims, 5 Drawing Sheets

FIG. 6A
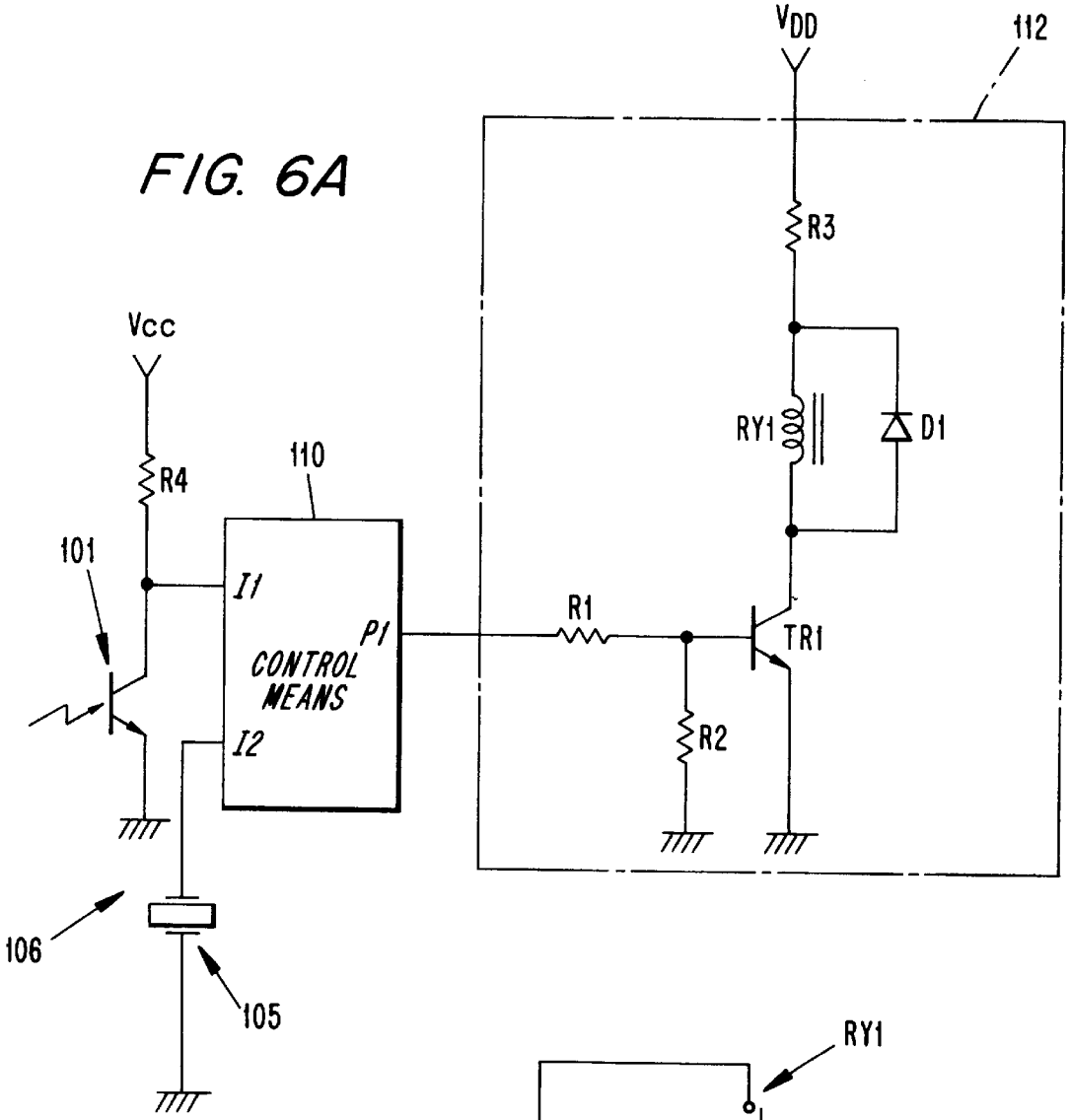
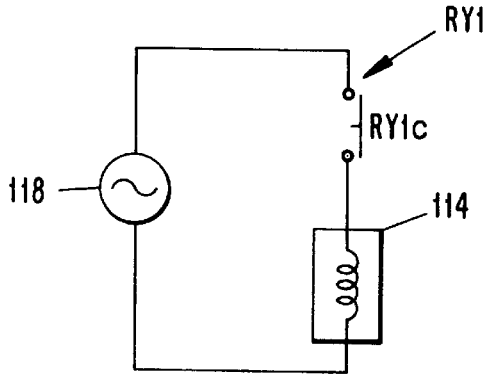
FIG. 6B

POWER SUPPLY CUT-OFF APPARATUS IN A MICROWAVE OVEN

BACKGROUND OF THE INVENTION

1. Field of the Invention

The present invention relates to a microwave oven and, in particular, to increasing the safety of workers performing repairs or maintenance thereon.

2. Description of the Prior Art

A conventional microwave oven, as illustrated in FIGS. 1 and 2, includes a cooking chamber 60 formed by a housing. The housing comprises various panels, including a front panel 20, a back panel 30, a base panel 40 and a removable outer panel 50. A turntable 70 is disposed on a floor of the cooking chamber 60. A door 80 is provided for opening and closing the cooking chamber 60, and a control unit 90 is provided for establishing cooking function modes or for operating a magnetron (not shown), or the like.

In order to drive the microwave oven thus constructed, when a door open button at the control unit 90 is pressed while an electric cord 100 is plugged in an electrical outlet, the door 80 is opened to light a lamp in the cooking chamber 60.

At this time, food is placed on the turntable 70, the door 80 is closed, a desired cooking time and cooking menu and the like are input by way of the control unit 90, and a start button is pressed. Then the turntable 70 is rotated in one direction as a high frequency of 2,450 MHZ is generated according to an oscillating operation of a magnetron (not shown) to thereafter be dispersed in the cooking chamber 60.

The high frequency dispersed in the cooking chamber 60 is reflected from metal walls therein and is radiated to the food on the turntable 70 to thereby heat the food.

However, there is a problem in the conventional microwave oven thus constructed in that an electric shock to a worker can happen when the outer panel 50 is separated while the electric cord 100 is still plugged in the outlet during repair or maintenance of the product.

SUMMARY OF THE INVENTION

Accordingly, the present invention is provided to solve the aforementioned problem and it is an object of the present invention to provide a power supply cut-off apparatus of a microwave oven by which an input power supply can be automatically cut off to thereby prevent an electric shock when the outer panel is separated while an electric cord is still in an outlet during repair of the product.

In accordance with the object of the present invention, there is provided a microwave oven comparing a housing formed by interconnected housing portions, a cooking chamber disposed in the housing, a door for opening and closing the cooking chamber, an electrical cord for supplying electrical power to the oven, and a power supply cut-off means mounted on the microwave oven for automatically cutting off the supply of electric power in response to an opening-up a portion of the housing. The power supply cut-off means comprises a safety switch for cutting off the supply of electric power, an electric solenoid operably connected to the safety switch for actuating the safety switch, and a sensor mechanism for detecting the opening-up of a portion of the housing. The sensor is electrically connected to the solenoid for causing the solenoid to actuate the safety switch and cutoff the supply of electric power in response to the opening-up of the portion of the housing.

The sensor mechanism preferably includes a trigger comprising a light sensor arranged to receive light in response to the opening-up of the portion of the housing.

The sensor mechanism may include in addition to, or as an alternative to the light sensor, a piezoelectric sensor arranged to vary a signal in response to the opening-up of the portion of the housing.

BRIEF DESCRIPTION OF THE DRAWINGS

For a fuller understanding of the nature and objects of the invention, reference should be made to the following detailed description taken in conjunction with the accompanying drawings in which:

FIG. 6A is a detailed circuit diagram of a separation detecting mechanism and a control circuit according to the present invention; and FIG. 6B is a circuit diagram of a solenoid driving mechanism according to the present invention.

DETAILED DESCRIPTION OF PREFERRED EMBODIMENTS OF THE INVENTION

Figure 1:
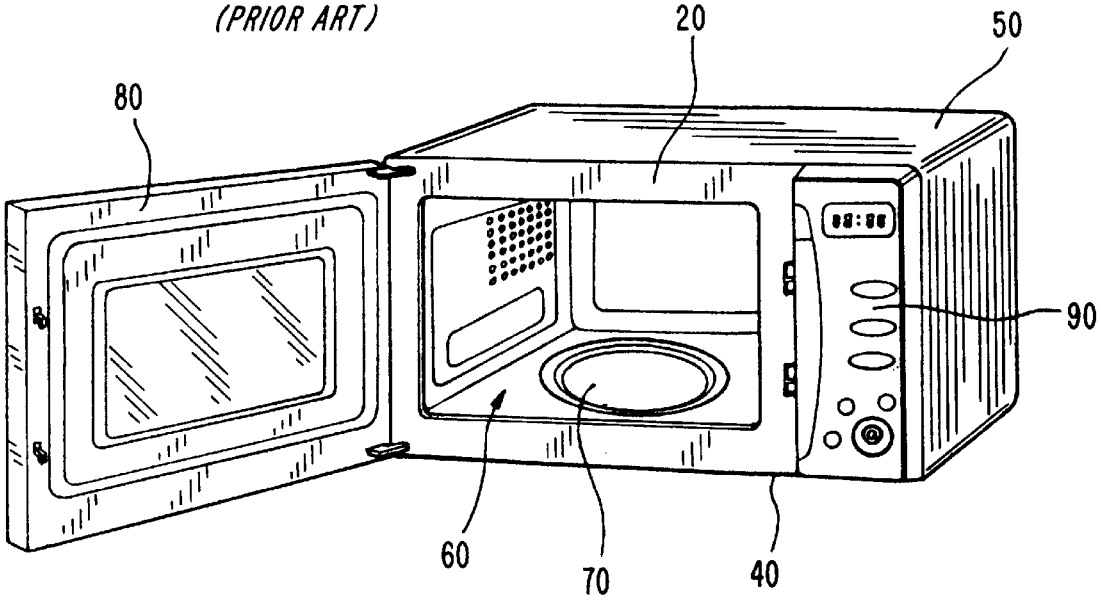
FIG. 1 (PRIOR ART)
FIG. 1 is a perspective view illustrating a front surface of a microwave oven according to the prior art.
Figure 2:
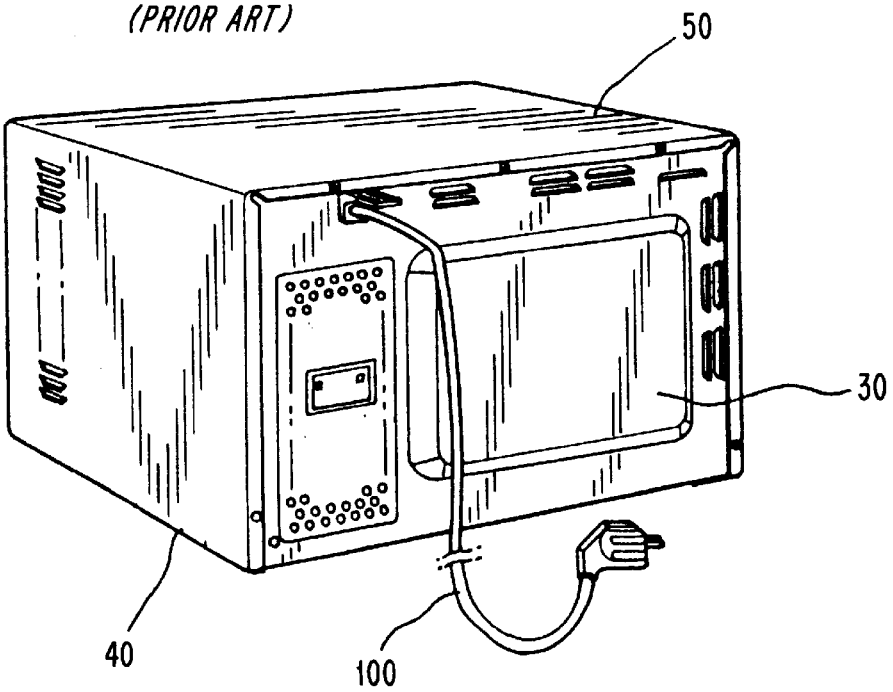
FIG. 2 (PRIOR ART)
FIG. 2 is a perspective view illustrating a rear surface of a microwave oven according to the prior art.

The preferred embodiments of the present invention will be described in detail with reference to the accompanying drawings, where, throughout the drawings like reference numerals and symbols as in FIGS. 1 and 2 are used for the designation of like or equivalent parts or portions for simplicity of illustration and explanation, and redundant references will be omitted accordingly.

Figure 3:
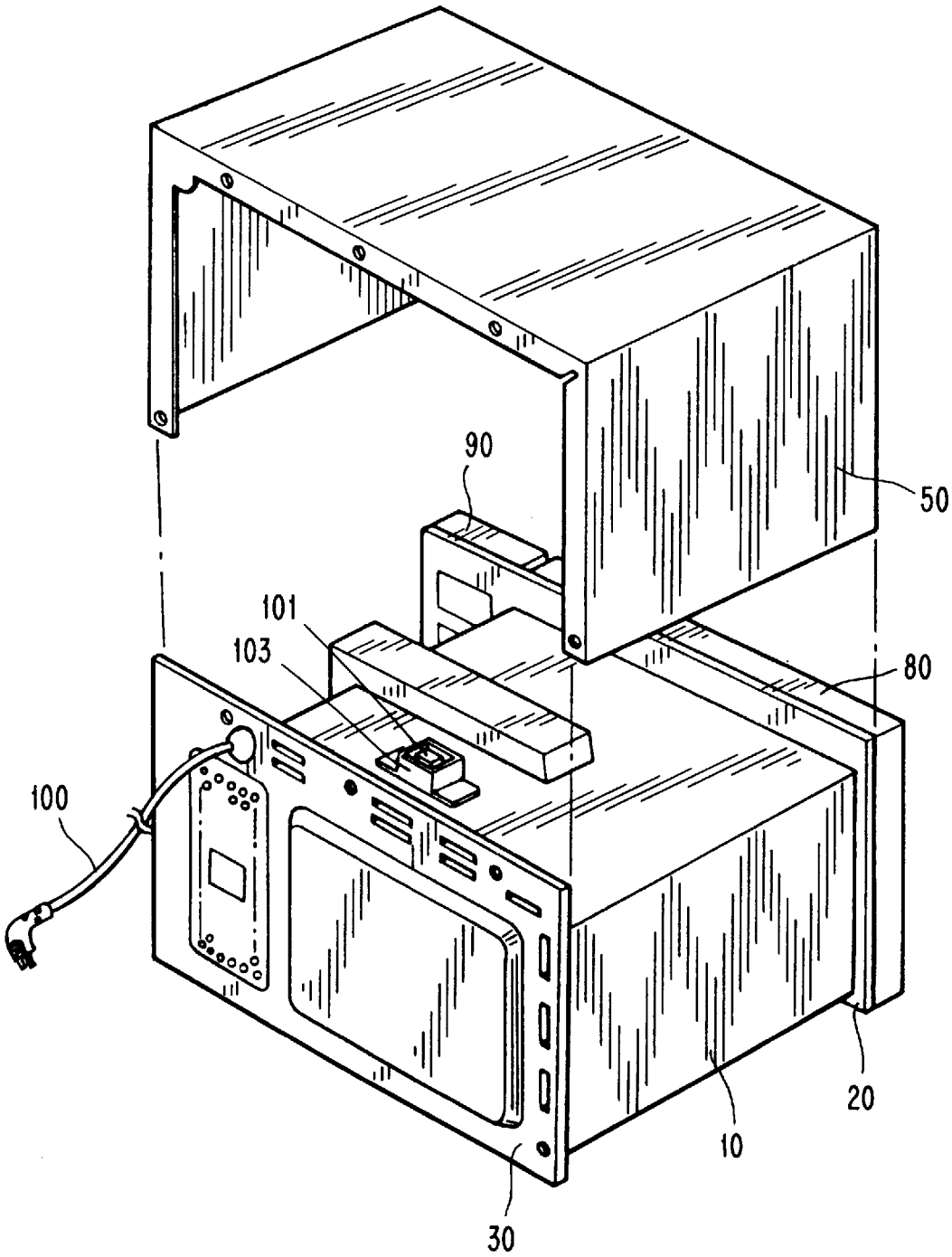
FIG. 3 is an exploded perspective view of a microwave oven illustrating a light sensor according to the present invention.

Illustrated in FIGS. 3, is a housing of a microwave oven which is similar to that described earlier in connection with FIGS. 1 and 2, except that the main section 10 is provided at an external upper side thereof with a light sensor or light operated semiconductor 101 in the form of a phototransistor (as shown) or a photosensitive diode, for detecting whether the outer panel 50 is separated from the main section 10 when a repair is performed, and the light sensor 101 is arranged within a protection case 103.

Figure 4:
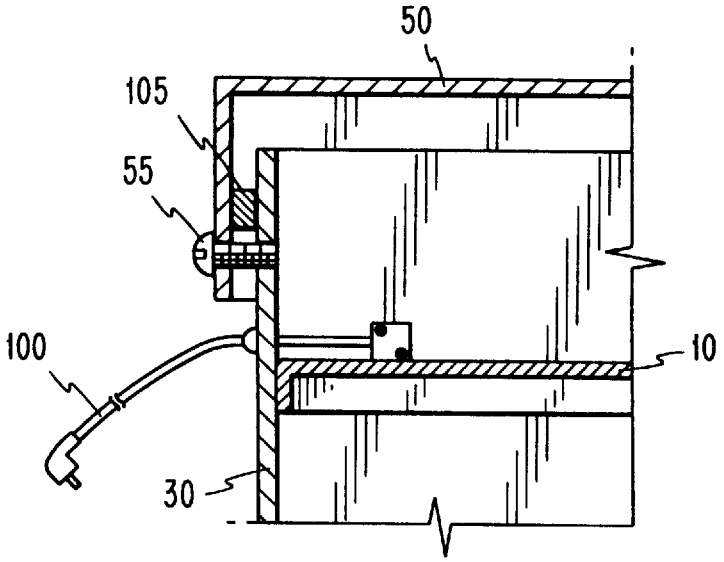
FIG. 4 is a side sectional view of the microwave oven of FIG. 3 illustrating a piezoelectric sensor according to present invention.

As illustrated in FIG. 4, the outer panel 50 and the back panel 30 are secured by a fastening bolt 55 and the back panel 30 is provided at an external upper side thereof with a piezoelectric crystal sensor 105 for detecting whether the outer panel 50 is separated from the back panel 30 when a repair is performed.

A circuit for cutting off an input power supply of a microwave oven when triggered by the light sensor 101 or the piezoelectric sensor 105 is described with reference to FIGS. 5, 6A and 6B.

Figure 5:
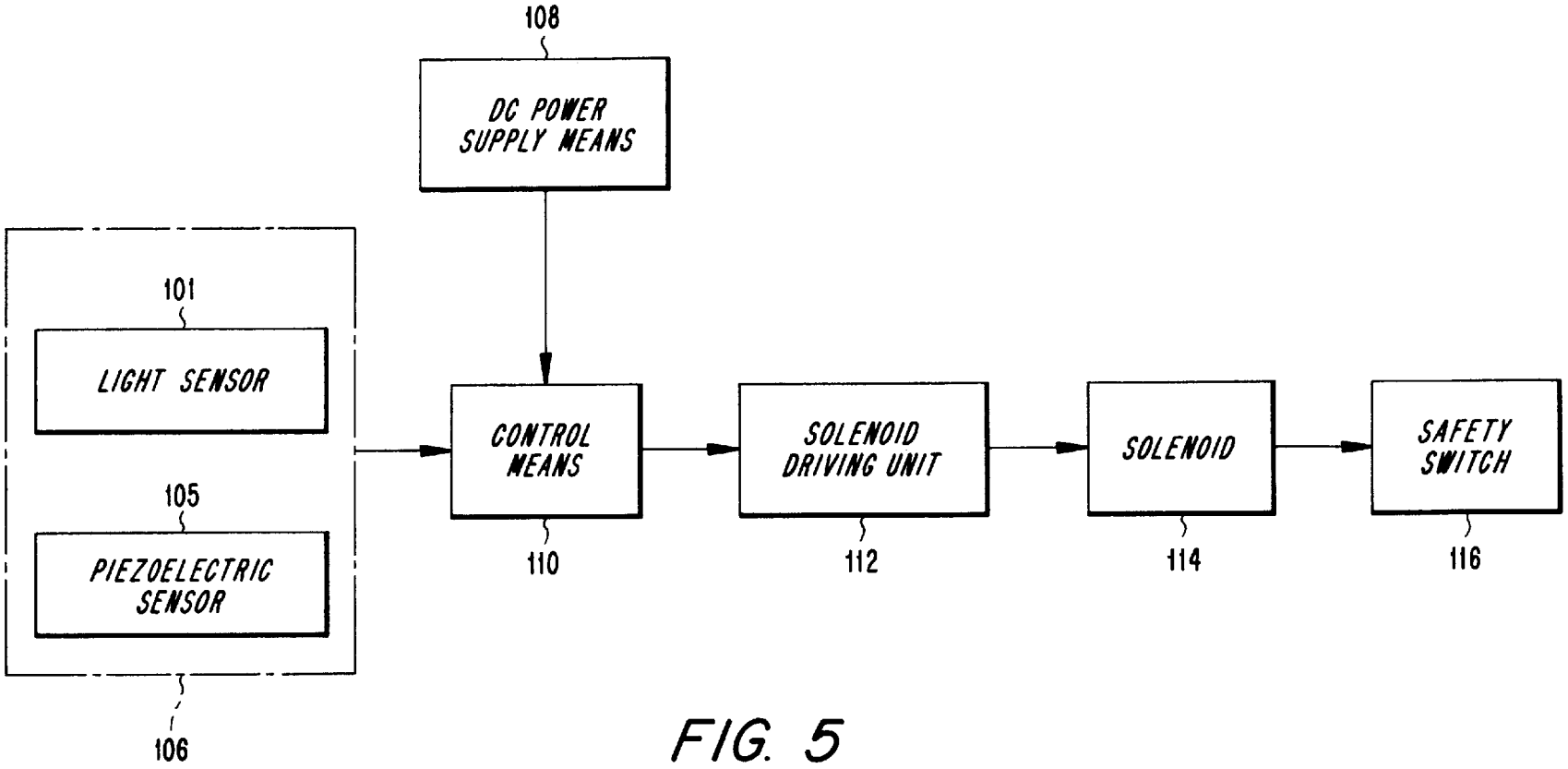
FIG. 5 is a control block diagram of a power supply cut-off apparatus of a microwave oven according to the present invention.

As shown in FIGS. 5, 6A and 6B, separation detecting means 106 serves to detect whether the outer panel 50 is dismantled and is composed of the light sensor 101 and/or the piezoelectric sensor 105 which operate independently of one another to provide a dual safety arrangement (although only one of the sensors could be used if desired). The light sensor 101 is normally in an off (inactive) state when blocked-off from light, i.e. when the panel 50 is in an assembled state, whereby a voltage is delivered to an input terminal 11 of a control means 110 from a source of direct current voltage Vcc (5 V) and a resistor R4. When the panel 50 is removed, light activates the now-exposed sensor 101 to reduce the voltage applied to the input terminal 11.

The piezoelectric element 105, when compressed between the panels 30 and 50, produces a voltage that is supplied to an inlet terminal 12 of the control means 110. When the panels 30, 50 are separated, the pressure on the piezoelectric element 105 is relived, whereby the amount of voltage applied to the terminal 12 is reduced.

The DC power supply means 108 receives an alternating current AC voltage supplied from an AC power supply terminal 118 and converts same to a predetermined DC voltage necessary for driving the microwave oven and outputs that DC voltage.

Control means 110 is a microcomputer which receives a DC voltage generated from the DC power supply source 108 to initialize the microwave oven and to determine whether or not the outer panel 50 has been dismounted from the main section 10 or from the back panel 30 according to a voltage signal detected by the separation detecting means 106, and to supply or cut off an input power supply applied to the microwave oven from the electric cord 100.

Solenoid driving unit 112 is adapted to receive a control signal output from the control means 110 to drive a solenoid 114 so that an input power supply applied from the electric cord 100 can be cut off. The solenoid driving unit 112 includes dividing resistors R1 and R2 for diving a control signal generated from an output terminal P1 at the control means 110, a transistor TR1 for receiving the divided signal divided by the dividing resistors R1 and R2 to thereby be turned on or turned off, a relay RY1 for receiving via a resistor R3 a DC voltage (VDD; 12 V) output from the DC power supply means 108 to drive the solenoid 114 when the transistor TR1 is turned on, and a protective diode D1 for bypassing a reverse power generating at the relay RY1 when the transistor TR1 is rendered active to thereby protect the transistor TR1.

Furthermore, a safety switch 116 electrically connects the AC power supply terminal 118 to the microwave oven so as to cut off an input power supply applied to the microwave oven from the AC power supply terminal 118 through the electric cord 100 when the solenoid 114 is activated by the solenoid driving unit 112.

Now, the operational of the power supply cut-off apparatus of a microwave oven thus constructed will be described.

It is presumed as an initial condition for describing an operation of the apparatus that a contact RY1c at the relay RY1 is opened, and potential of the output terminal P1 at the control means 110 is lower level.

First of all, when the microwave oven is supplied with an input power supply, an AC voltage supplied from the AC power supply terminal 118 is converted to a predetermined DC voltage (Vcc; 5 V) necessary for activating the microwave oven and is emitted to the control means 110.

The control means 110 receives the driving voltage of 5 V output from the DC power supply means 108 to initialize the microwave oven.

At this time, when food is placed on the turntable 70, a cooking time, cooking function and the like are input via the manipulating unit 90 and a start button is pressed. Consequently, a manipulating command and an operation start signal are input to the control means 110 from the manipulating unit 90.

The control means 110 controls an oscillating operation of a magnetron according to the operation start signal output from the manipulating unit 90. The magnetron radiates a high frequency into the cooking chamber 60 to perform the cooking operation.

It is now assumed that repair work is to be performed on the oven, and that the worker does not unplug the cord 100.

Light Sensor

When the fastening bolt 55 is unscrewed to dismantle the outer panel 50 and the back panel 30, and the outer panel 50 is pulled upward to perform the repair work, light is radiated into the protective case 103 to thereby activate the light sensor 101.

When the light sensor 101 is rendered active, the input terminal 11 of the control means 110 receives a reduced voltage and compares that reduced voltage with a reference voltage.

The control means 110 now determines that the outer panel 50 has been separated from the main section 10 and outputs via the output terminal P1 a control signal of high level to the solenoid driving unit 112 in order to cut off the input power supply.

The control signal is divided via the dividing resistors R1 and R2 to be applied to a base terminal of the transistor TR1, to thereby activate the transistor TR1.

When the transistor TR1 is rendered active the relay RY1 is activated to close the contact RY1c at the relay RY1 (see FIG. 6B) because a current flows to a ground terminal via the resistor R3 and relay RY1 and through the transistor TR1 according to DC voltage (VDD) output from the DC power supply means 108.

When the contact RY1c at the relay RY1 is closed, the AC voltage supplied from the AC power supply terminal 118 is applied to a coil of the solenoid 114 via the contact RY1c at the relay RY1 to thereby activate the solenoid 114.

When the solenoid is rendered active, the safety switch 116 is rendered inactive to cut off the AC power supply input to the microwave oven via the electric cord 100 from the AC power supply terminal 118, so that a danger of the worker getting an electrical shock is prevented.

When the repair job is completed, the outer panel 50 and the back panel are assembled, preventing light from being radiated into the protective case 103, to deactivate the light sensor 101.

When the light sensor 101 is deactivated a high voltage signal is input into the input terminal 11 of the control means 110. The control means 110 compares the pre-established reference voltage value with the high voltage value from the light sensor 101 and determines that the outer panel 50 is assembled to the back panel 30, and generates to the solenoid driving unit 112 a control signal of low level via the output terminal P1.

Successively, the control signal of low level output from the output terminal P1 of the control means 110 is divided via the dividing resistors R1 and R2 to be applied to the base terminal of the transistor TR1 to deactivate the transistor TR1.

When the transistor TR1 is rendered inactive, no current flows in the relay RY1 to open the contact RY1c of the relay RY1 as in the initialization state.

When the contact RY1c is opened, the AC voltage applied to the coil of the solenoid 114 via the contact RY1c of the relay RY1 from the AC power supply terminal 118 is cut off to thereby deactivate the solenoid 114.

When the solenoid 114 is rendered inactive, the safety switch 116 is turned on to thereby allow an AC power supply to be applied via the electric cord 100 to the microwave oven.

Meanwhile, although the above description has described a power cut off in response to the output panel 50 being pulled upward to separate the outer panel 50 from the cavity, the present invention is not limited thereto.

Piezoelectric Sensor

When the outer panel 50 is pulled backward to be separated from the back panel 30, pressure on the piezoelectric element 105 is relieved, thereby reducing the voltage applied to the input terminal 12.

Successively, the control means 110 compares that reduced voltage with the pre-established reference value and determines that the outer panel 50 is separated from the back panel 30 and outputs a control signal of high level via the output terminal P1 to the solenoid driving unit 112, to automatically cut off the input power supply in the manner descried above.

As is apparatus from the foregoing, an advantage results from the power supply cut-off apparatus of a microwave oven according to the present invention, in that an electric power supply can be automatically cut off when the outer panel 50 is removed with the electric cord 100 still plugged in an electrical outlet during a repair work of the product, to thereby prevent the worker from receiving an electric shock.

Although the present invention has been described in connection with preferred embodiments thereof, it will be appreciated by those skilled in the art that additions, deletions, modifications, and substitutions not specifically described may be made without departing from the spirit and scope of the invention as defined in the appended claims.

What is claimed is:

1. A microwave oven comprising a housing formed by interconnected housing portions, a cooking chamber disposed in the housing, a door for opening and closing the cooking chamber, an electrical cord for supplying electrical power to the oven, and a power supply cut-off means mounted on the microwave oven for automatically cutting off the supply of electric power in response to an opening-up of a portion of the housing, the power supply cut-off means comprising:

a safety switch for cutting-off the supply of electric power, an electric solenoid operably connected to the safety switch for activating the safety switch; and a sensor mechanism for detecting the opening-up of a portion of the housing, the sensor being electrically connected to the solenoid for causing the solenoid to actuate the safety switch and cut-off the supply of electrical power in response to the opening-up of the portion of the housing;

wherein the sensor mechanism includes a trigger comprising a light sensor arranged to receive light in response to the opening-up of the portion of the housing, and another trigger comprising a piezoelectric sensor arranged to vary a signal in response to the opening up of the portion of the housing.

2. The microwave oven according to claim 1 wherein the housing portions includes a top panel overlying a top wall of the cooking chamber, the light sensor disposed beneath the panel.

3. The microwave oven according to claim 1 wherein the light sensor is disposed within a protective case.

4. The microwave oven according to claim 1 further comprising a controller for controlling the electric solenoid in response to a magnitude of a voltage applied to the controller, the sensor mechanism operable to reduce the magnitude of the voltage in response to an opening-up of the portion of the housing to cause the switch to cut-off the supply of electric power.

5. A microwave oven comprising a housing formed by interconnected housing portions, a cooking chamber disposed in the housing, a door for opening and closing the cooking chamber, an electrical cord for supplying electrical power to the oven, and a power supply cut-off means mounted on the microwave oven for automatically cutting off the supply of electric power in response to an opening-up of a portion of the housing, the power supply cut-off means comprising:

a safety switch for cutting-off the supply of electric power, an electric solenoid operably connected to the safety switch for activating the safety switch; and a sensor mechanism for detecting the opening-up of a portion of the housing, the sensor being electrically connected to the solenoid for causing the solenoid to actuate the safety switch and cut-off the supply of electrical power in response to the opening-up of the portion of the housing;

wherein the sensor mechanism includes a trigger comprising a piezoelectric crystal unit arranged to vary a signal in response to the opening up of the portion of the housing;

and further wherein the housing portions include two mutually separable panels having respective vertically extending sections spaced apart from one another, the piezoelectric crystal unit mounted horizontally between the vertically extending sections and compressed thereby.

* * * * *